US008408175B2

(12) United States Patent
Schoenek et al.

(10) Patent No.: US 8,408,175 B2
(45) Date of Patent: Apr. 2, 2013

(54) STOP-START SELF-SYNCHRONIZING STARTER SYSTEM

(75) Inventors: Norman Schoenek, Novi, MI (US); Michael G. Reynolds, Troy, MI (US); Gary E. McGee, Oxford, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 193 days.

(21) Appl. No.: 12/849,456

(22) Filed: Aug. 3, 2010

(65) Prior Publication Data

US 2012/0031231 A1 Feb. 9, 2012

(51) Int. Cl.
*F02N 15/02* (2006.01)

(52) U.S. Cl. ..... 123/179.1; 123/179.28; 123/179.25

(58) Field of Classification Search ..... 123/179.1, 123/179.4, 179.28, 179.25; 180/65.2
See application file for complete search history.

(56) References Cited

U.S. PATENT DOCUMENTS

| | | | | |
|---|---|---|---|---|
| 4,022,164 | A * | 5/1977 | Fuchs | 123/339.14 |
| 4,439,720 | A * | 3/1984 | Georges | 322/4 |
| 4,499,965 | A * | 2/1985 | Oetting et al. | 180/165 |
| 6,098,584 | A * | 8/2000 | Ahner et al. | 123/179.3 |
| 6,250,270 | B1 * | 6/2001 | Ahner et al. | 123/179.3 |
| 6,365,983 | B1 * | 4/2002 | Masberg et al. | 290/40 C |
| 6,499,370 | B2 * | 12/2002 | Bowen | 74/330 |
| 6,710,579 | B2 * | 3/2004 | Ebel et al. | 322/4 |
| 6,722,332 | B2 * | 4/2004 | Kojima | 123/179.3 |
| 8,036,815 | B2 * | 10/2011 | Okumoto et al. | 701/110 |
| 8,069,832 | B2 * | 12/2011 | Okumoto et al. | 123/179.4 |
| 2008/0156550 | A1 * | 7/2008 | Wei et al. | 180/65.2 |
| 2010/0064786 | A1 * | 3/2010 | Ge et al. | 73/114.25 |
| 2011/0118962 | A1 * | 5/2011 | Couetoux et al. | 701/113 |
| 2011/0139108 | A1 * | 6/2011 | Hashim | 123/179.3 |
| 2011/0178695 | A1 * | 7/2011 | Okumoto et al. | 701/103 |
| 2011/0184626 | A1 * | 7/2011 | Mauritz et al. | 701/102 |
| 2012/0035827 | A1 * | 2/2012 | Kuniyoshi et al. | 701/102 |

FOREIGN PATENT DOCUMENTS

| | | | |
|---|---|---|---|
| DE | 102008054984 | A1 | 6/2010 |
| JP | 2005-330813 | * | 12/2005 |
| JP | 2006-132343 | * | 5/2006 |

* cited by examiner

*Primary Examiner* — Hai Huynh
(74) *Attorney, Agent, or Firm* — Quinn Law Group, PLLC

(57) ABSTRACT

A starter system is provided for an engine having a stop-start capability. The starter system includes a first gear coupled to the engine, wherein the first gear rotates at a speed of the engine. The starter system also includes a starter arranged relative to the engine. The starter includes a second gear arranged to selectively mesh with and apply torque to the first gear in order to start the engine, such that the second gear is capable of rotating at the speed of the engine. The starter additionally includes a synchronizer arranged to substantially match the speed of the first gear with the speed of the engine prior to engagement of the first and second gears, such that the second gear is enabled to mesh with and apply torque to the first gear to thereby start the engine. The starter system and the engine may be employed in a vehicle.

16 Claims, 2 Drawing Sheets

STOP-START SELF-SYNCHRONIZING STARTER SYSTEM

TECHNICAL FIELD

The invention relates to a stop-start self-synchronizing starter system employed for starting an engine of a motor vehicle.

BACKGROUND

In a motor vehicle, the vehicle's engine, such as an internal combustion engine, is typically rotated via a starter to cause the engine to begin powering itself. A typical starter includes a pinion gear that is driven by an electric motor, and is pushed out for engagement with a ring gear that is attached to the engine's flywheel or flex-plate, in order to start the engine.

In some vehicle applications, a stop-start system is employed, where the engine is automatically stopped or shut off to conserve fuel when vehicle propulsion is not required, and is then automatically re-started by a starter when vehicle drive is again requested. Such a stop-start system may be employed in a conventional vehicle having a single powerplant, or in a hybrid vehicle application that includes both an internal combustion engine and a motor/generator for powering the vehicle.

SUMMARY

A starter system is disclosed herein for an engine having a stop-start capability. The starter system includes a first gear coupled to the engine, such that the first gear rotates at a speed of the engine. The starter system also includes a starter arranged relative to the engine. The starter includes a second gear arranged to selectively mesh with and apply torque to the first gear in order to start the engine, such that the second gear is capable of rotating at the speed of the engine. The starter additionally includes a synchronizer arranged to substantially match the speed of the second gear with the speed of the engine prior to engagement of the first and second gears, such that the second gear is enabled to mesh with and apply torque to the first gear to thereby start the engine.

The first gear may also include a first frictional surface, and the synchronizer may include a second frictional surface configured to be driven into contact with the first frictional surface. Such contact between the first and second frictional surfaces is intended to substantially match the speed of the first gear with the speed of the engine.

Each of the first and second frictional surfaces may be arranged as substantially complementary conical surfaces. The second frictional surface may be formed from a plastic material.

The starter may also include an over-running clutch operatively connected to the second gear, arranged to be displaced toward the first gear. Such an over-running clutch may be configured to transmit torque of the starter to the second gear when the first gear rotates slower than the second gear, and to freewheel when the first gear rotates faster than the second gear.

The starter may additionally include a spring arranged between the synchronizer and the over-running clutch to thereby urge the synchronizer away from the over-running clutch and toward the first gear.

Furthermore, the starter may include a shaft fixedly connecting the second gear and the over-running clutch. The synchronizer may be disposed on the shaft between the second gear and the over-running clutch. Each of the shaft and synchronizer may include complementary splines such that the synchronizer slides along the shaft and compresses the spring when the second gear is being meshed with the first gear.

Moreover, the starter may include a solenoid configured to displace the over-running clutch toward the first gear and thereby urge the synchronizer by the action of the spring toward the frictional surface.

The engine having such a starter system may be arranged in a hybrid-electric type motor vehicle having a motor/generator. In such a case, the engine may be configured to be selectively shut off when the motor/generator is running and be re-started via the starter for powering the vehicle. The disclosed starter may be operated by a 12-volt electrical system.

The above features and advantages and other features and advantages of the present invention are readily apparent from the following detailed description of the best modes for carrying out the invention when taken in connection with the accompanying drawings.

DETAILED DESCRIPTION

Figure 1:
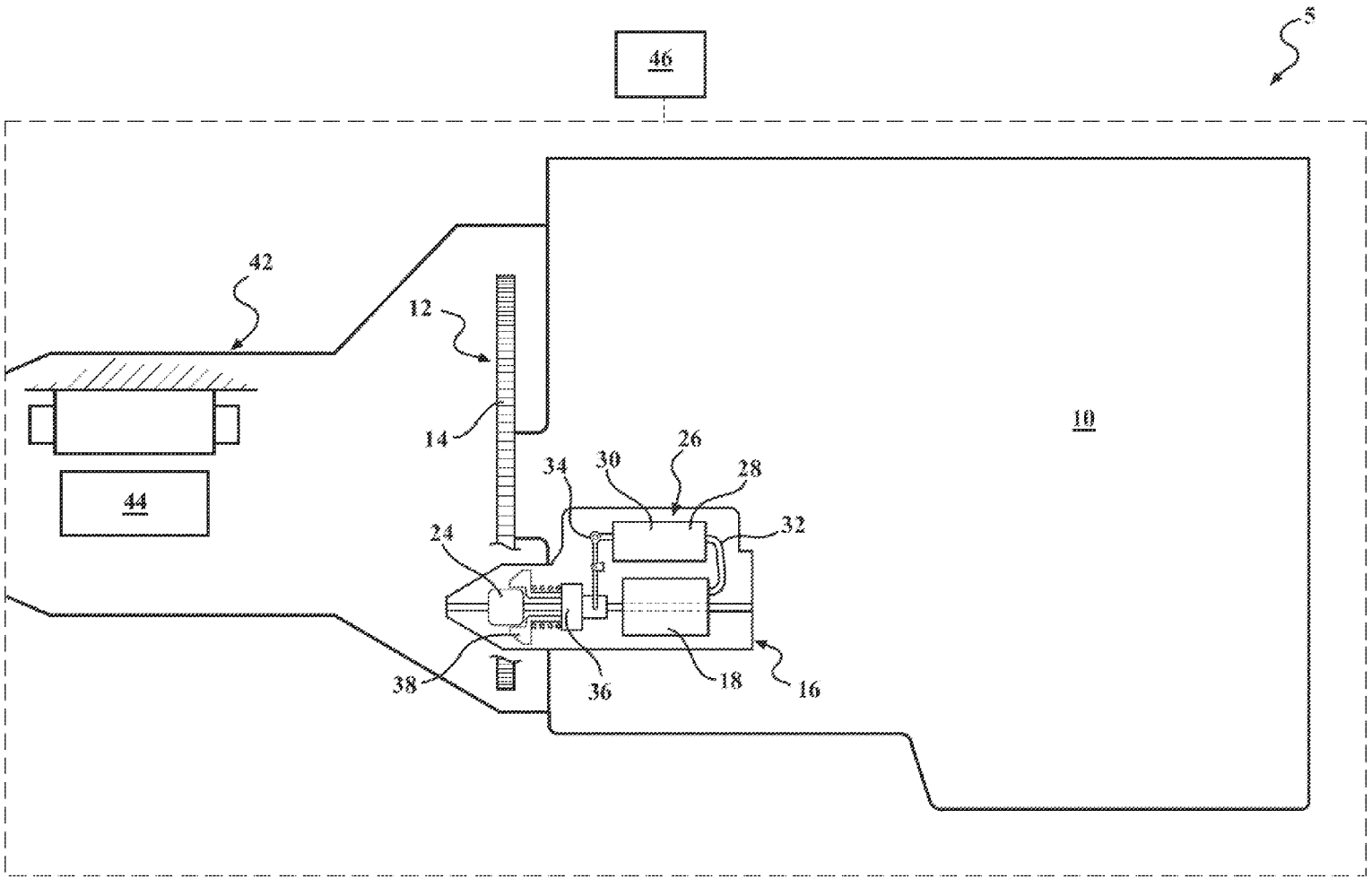
FIG. 1 is a schematic illustration of a motor vehicle powertrain including a stop-start synchronizing starter system for an engine.

Referring to the drawings, wherein like reference numbers refer to like components, FIG. 1 shows a schematic view of an exemplary embodiment of a starter system 5 for a hybrid-electric vehicle powertrain. Starter system 5 includes an engine 10. Although starter system 5 is illustrated for a hybrid-electric vehicle powertrain, the system may be employed in any vehicle powertrain having engine 10.

Engine 10 includes a flywheel (or a flex-plate) 12 attached to a crankshaft (not shown) of the engine, and, as such, rotates at the same speed as the engine. Flywheel 12 is typically attached to the crankshaft via fasteners such as bolts or screws (not shown). A first gear, which is a ring gear 14 having a specific gear tooth profile and spacing, is arranged on the outer perimeter of the flywheel 12. Ring gear 14 typically has an outer diameter that is designed to facilitate effective starting of engine 10, as understood by those skilled in the art.

Figure 2:
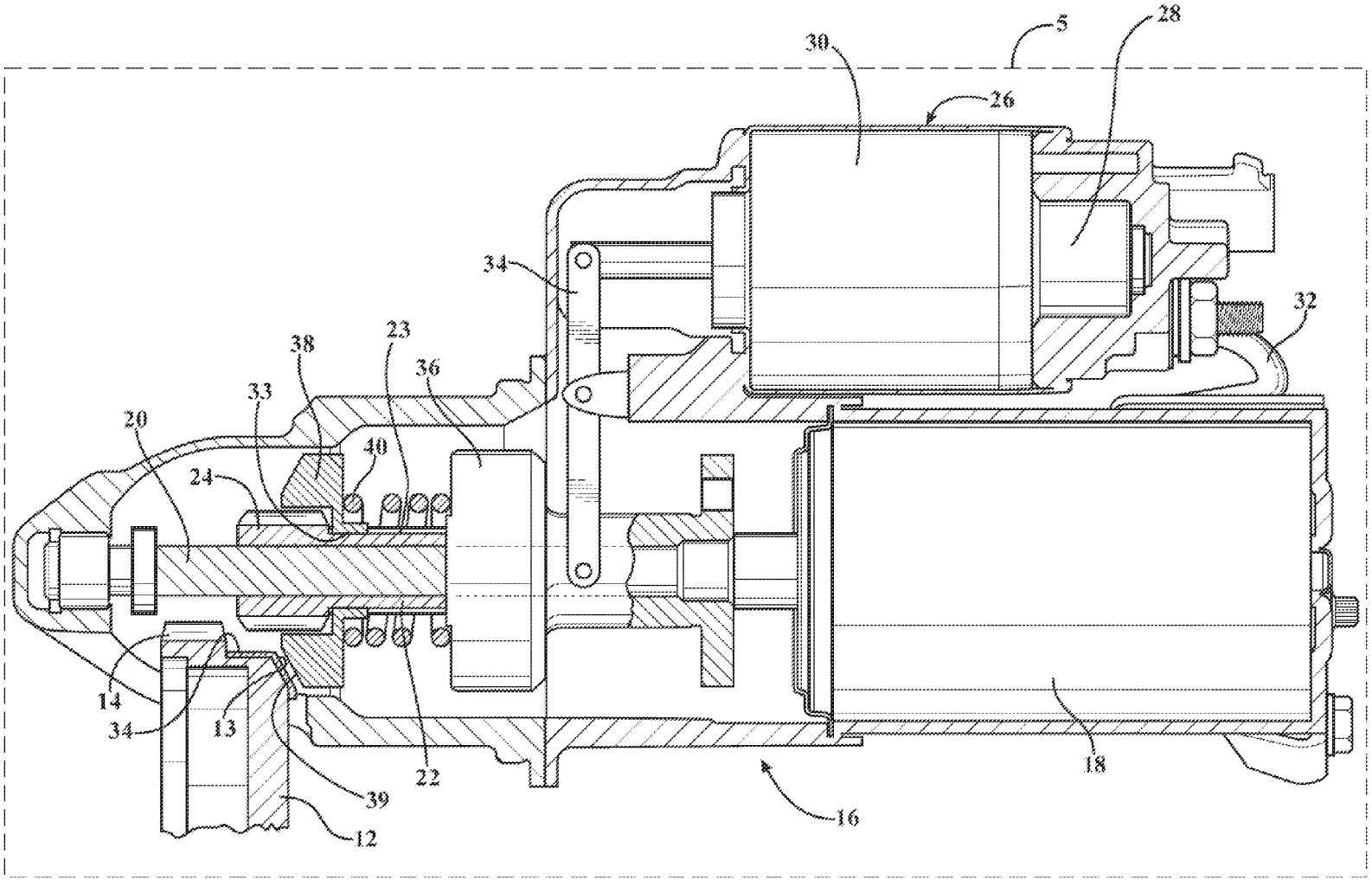
FIG. 2 is a partial cross-sectional view of the stop-start synchronizing starter system depicted in FIG. 1.

A starter 16 is arranged relative to the engine 10 in close proximity to the ring gear 14 for starting the engine. Starter 16 may be mounted directly on engine 10 to reduce the effect of manufacturing tolerances, as shown in FIG. 1. Starter 16 is shown in greater detail in FIG. 2. Starter 16 includes an electric motor 18 that is employed to rotate a center shaft 20. A hollow or sleeve shaft 22 is arranged concentrically around center shaft 20 with a clearance fit, such that the sleeve shaft may rotate with respect to the center shaft. A second gear 24, otherwise known as a pinion gear, is integral with sleeve shaft 22. Pinion gear 24 is fixed on sleeve shaft 22 for unitary rotation therewith, and is arranged to selectively mesh with and apply torque to ring gear 14 in order to start engine 10. Pinion gear 24 is capable of rotating at any speed that corresponds to the speed of engine 10 when starting the engine may be required. Pinion gear 24 includes a gear tooth profile and spacing that corresponds to that of the ring gear 14 for accurate meshing and engagement therewith.

Starter 16 includes a pinion engagement solenoid assembly 26, which incorporates a motor solenoid 28 and a pinion-shift solenoid 30. Electric motor 18 is activated by motor solenoid 28 via an electrical connection 32 or via a suitable lever arrangement (not shown), in order to rotate center shaft 20. The motor solenoid 28 receives electrical power from an energy storage device (not shown) that is located on-board the host vehicle. Typically, a positive electrical connection from the energy storage device is connected to the solenoid assembly 26, and a negative electrical connection is connected to the body or case of starter 16. When the motor solenoid 28 completes the electrical circuit, electrical power is applied to rotate center shaft 20. Pinion-shift solenoid 30 is configured to energize a lever arrangement 34. When energized by the pinion-shift solenoid 30, lever arrangement 34 in turn displaces pinion gear 24 for meshed engagement with the ring gear 14, in order to start engine 10.

Starter 16 additionally includes an over-running clutch (ORC) 36, such as the type that includes an inner and an outer race, and either a sprag or a roller assembly arranged between the inner and outer races. Although the internal construction of ORC 36 is not shown, the ORC is configured to affect a freewheeling or overrunning operation when either the inner or the outer race is rotating faster than the other race, and to lock the inner and outer races together for unitary rotation when the relative speeds of the races are reversed. In the embodiment shown, the outer race of the ORC 36 is connected for rotation with center shaft 20, while the inner race is connected to sleeve shaft 22 and to pinion gear 24 for rotation therewith. ORC 36 is arranged to be displaced toward ring gear 14 by the action of the lever arrangement 34. ORC 36 is configured to transmit starter torque generated by the electric motor 18 to pinion gear 24 when the rotational speed of flywheel 12 is slower than that of the pinion gear 24, and to freewheel or overrun in the opposite situation.

A synchronizer 38 is disposed on the sleeve shaft 22. Synchronizer 38 is arranged to be displaced along sleeve shaft 22 toward a first frictional surface 13 on ring gear 14. Synchronizer 38 includes a second frictional surface 39 that is configured to be driven into contact with first frictional surface 13 in order to alter the rotational speed of pinion gear 24 and substantially match the speed of the pinion gear with the speed of ring gear 14. Synchronizer 38 may be formed from plastic, or any other material suitable to transmit torque of electric motor 18 to flywheel 12, and accomplish the substantial matching of rotational speeds of pinion gear 24 and ring gear 14.

Pinion-shift solenoid 30 displaces ORC 36 along with synchronizer 38 toward the flywheel 12. Following the substantial synchronization of the speeds of pinion gear 24 and flywheel 12 via synchronizer 38, the pinion gear is translated via the pinion-shift solenoid 30 further toward the ring gear 14 for meshed engagement therewith in order to start engine 10. Electric motor 18 is activated by the motor solenoid 28, following the substantial synchronization of the speeds of pinion gear 24 and flywheel 12 in order to start engine 10 via the pinion gear. Once engine 10 has been started, pinion gear 24 is disengaged from ring gear 14, and is retracted to its resting position via deactivation of the pinion-shift solenoid 30.

A spring 40 is arranged concentrically around sleeve shaft 22 between synchronizer 38 and ORC 36, to thereby urge the synchronizer away from the ORC and toward ring gear 14. The urging of synchronizer 38 toward flywheel 12 and loading the synchronizer against the flywheel operate to substantially match the speed of pinion gear 24 with the speed of engine 10. Following the matching of speeds of pinion gear 24 and engine 10, the pinion gear is driven by lever arrangement 34 via sleeve shaft 22 to mesh with and apply torque to ring gear 14, to thereby start the engine. Additionally, sleeve shaft 22 includes a spline 23 that is arranged on the shaft's outer diameter, while synchronizer 38 includes a complementary spline 39. Splines 23 and 39 enjoy a relatively loose fit, such that synchronizer 38 may slide easily along sleeve shaft 22 toward the flywheel 12 for synchronization, and back toward ORC 36 against the action of spring 40 when pinion gear 24 is being meshed with ring gear 14.

Such synchronization of the rotational speeds of pinion gear 24 and flywheel 12 results in improved durability of the starter 16, as well as reduced noise, vibration, and harshness (NVH) during starting of engine 10. Starter system 5 is particularly useful for re-starting engine 10 when, following engine shut-off, the speed of the engine did not, for whatever reason, decrease to zero revolutions per minute (RPM). Starter 16 may be employed in any vehicle having an engine 10, but is particularly beneficial in a vehicle where engine 10 has a stop-start feature. As is known by those skilled in the art, a stop-start feature in an engine is where the engine is capable of being shut off when engine power is not required, but which may also be immediately restarted when engine power is again called upon to power the vehicle. Starter 16 may be sized to operate within the framework of a standard for the automotive industry 12-volt electric system, thereby offering an efficient, i.e., low cost and weight, stop-start system for engine 10.

Referring back to FIG. 1, a transmission 42 is connected to engine 10 for transmitting engine power to drive wheels (not shown) of the subject vehicle. Transmission 42 also includes an appropriate gear-train arrangement, which is not shown, but the existence of which will be appreciated by those skilled in the art. Arranged inside transmission 42 is a motor-generator 44. Motor-generator 44 is employed to propel the subject vehicle either in concert with, or unaccompanied by engine 10. Engine 10 is capable of being shut off when the motor-generator 44 is running, such that the starter system 5 may be employed even while the subject vehicle is on the move. Additionally, the capability of synchronizer 38 to substantially match speeds of pinion gear 24 and flywheel 12 prior to engaging and meshing the pinion gear with ring gear 14, permits starter 16 to re-start engine 10 even when engine speed has not dropped all the way to zero RPM.

A controller 46 is arranged on the vehicle relative to the engine 10 and transmission 42, and configured to control operation of both the engine and the transmission, including the shutting down and re-starting of the engine during the stop-start procedure. Controller 46 is programmed to activate starter 16 on demand to extend synchronizer 38 to mechanically substantially match or synchronize the rotational speed of the pinion gear 24 with the rotational speed of the flywheel 12, based on predetermined vehicle operating parameters. Vehicle operating parameters may be predetermined empirically during calibration and testing phases of vehicle development, with the aim of optimizing performance, drivability and efficiency of the subject vehicle.

While the best modes for carrying out the invention have been described in detail, those familiar with the art to which this invention relates will recognize various alternative designs and embodiments for practicing the invention within the scope of the appended claims.

The invention claimed is:

1. A starter system for an engine having a stop-start capability, the starter system comprising:

a first gear coupled to the engine, such that the first gear rotates at a speed of the engine; and a starter arranged relative to the engine, the starter having:

a second gear arranged to selectively mesh with and apply torque to the first gear in order to start the engine, wherein the second gear is capable of rotating at the speed of the engine;

a synchronizer device configured to substantially match the speed of the second gear with the speed of the engine prior to engagement of the first and second gears, such that the second gear is enabled to mesh with and apply torque to the first gear to thereby start the engine; and an over-running clutch operatively connected to the second gear, arranged to be displaced toward the first gear, and configured to transmit the starter torque to the second gear when the first gear rotates slower than the second gear and freewheel when the first gear rotates faster than the second gear;

wherein the first gear includes a first frictional surface and the synchronizer device includes a second frictional surface configured to be driven into contact with the first frictional surface to thereby substantially match the speed of the second gear with the speed of the engine.

2. The starter system of claim 1, wherein each of the first and second frictional surfaces are substantially complementary conical surfaces.

3. The starter system of claim 1, wherein the second frictional surface is formed from a plastic material.

4. The starter system of claim 1, wherein the starter additionally includes a spring arranged between the synchronizer and the over-running clutch to thereby urge the synchronizer device away from the over-running clutch and toward the first gear.

5. The starter system of claim 4, wherein the starter additionally includes a shaft fixedly connecting the second gear and the over-running clutch, the synchronizer device is disposed on the shaft between the second gear and the over-running clutch, and each of the shaft and the synchronizer device includes complementary splines such that the synchronizer device slides along the shaft and compresses the spring when the second gear is being meshed with the first gear.

6. The starter system of claim 4, wherein the starter additionally includes a solenoid configured to displace the over-running clutch toward the first gear and thereby urge the synchronizer device by the action of the spring toward the frictional surface.

7. The starter system of claim 1, wherein the engine is arranged in a hybrid-electric type motor vehicle and is configured to be selectively shut off and re-started via the starter for powering the vehicle.

8. The starter system of claim 1, wherein the starter is configured to be operated by a 12-volt electrical system.

9. A motor vehicle comprising:

an engine having a stop-start capability; and a starter system arranged relative to the engine, the starter system including:

a first gear coupled to the engine, such that the first gear rotates at a speed of the engine; and a starter having:

a second gear arranged to selectively mesh with and apply torque to the first gear in order to start the engine, wherein the second gear is capable of rotating at the speed of the engine; and a synchronizer device configured to substantially match the speed of the second gear with the speed of the engine prior to engagement of the first and second gears, such that the second gear is enabled to mesh with and apply torque to the first gear to thereby start the engine for powering the vehicle; and an over-running clutch operatively connected to the second gear, arranged to be displaced toward the first gear, and configured to transmit the starter torque to the second gear when the first gear rotates slower than the second gear and freewheel when the first gear rotates faster than the second gear;

wherein the first gear includes a first frictional surface and the synchronizer device includes a second frictional surface configured to be driven into contact with the first frictional surface to thereby substantially match the speed of the second gear with the speed of the engine.

10. The vehicle of claim 9, wherein each of the first and second frictional surfaces are substantially complementary conical surfaces.

11. The vehicle of claim 9, wherein the second frictional surface is formed from a plastic material.

12. The vehicle of claim 9, wherein the starter additionally includes a spring arranged between the synchronizer device and the over-running clutch to thereby urge the synchronizer device away from the over-running clutch and toward the first gear.

13. The vehicle of claim 12, wherein the starter additionally includes a shaft fixedly connecting the second gear and the over-running clutch, the synchronizer device is disposed on the shaft between the second gear and the over-running clutch, and each of the shaft and the synchronizer device includes complementary splines such that the synchronizer device slides along the shaft and compresses the spring when the second gear is being meshed with the first gear.

14. The vehicle of claim 12, wherein the starter additionally includes a solenoid configured to displace the over-running clutch toward the first gear and thereby urge the synchronizer device by the action of the spring toward the frictional surface.

15. The vehicle of claim 9, further comprising a motor/generator capable of propelling the vehicle, wherein the engine is capable of being selectively shut off when the motor/generator is running and re-started via the starter for powering the vehicle.

16. The vehicle of claim 9, wherein the starter is configured to be operated by a 12-volt electrical system.

* * * * *